United States Patent [19]

Kozel

[11] Patent Number: 4,827,238

[45] Date of Patent: May 2, 1989

[54] REVERSIBLE BLADE TERMINAL FUSES

[76] Inventor: Emmett L. Kozel, Rte. 1, Box 306, Rockingham, N.C. 28379

[21] Appl. No.: 216,352

[22] Filed: Jul. 8, 1988

[51] Int. Cl.[4] ..... H01H 85/14

[52] U.S. Cl. ..... 337/256; 337/255; 337/264

[58] Field of Search ..... 337/256, 257, 258, 259, 337/229, 230, 255, 264, 260, 251, 252, 198; 439/621, 622, 624, 628, 698, 830; 29/623

[56] References Cited

U.S. PATENT DOCUMENTS 3,813,626 5/1974 Cetola et al. ..... 337/264
4,385,282 5/1983 Ahroni ..... 337/198

FOREIGN PATENT DOCUMENTS 2940607 4/1981 Fed. Rep. of Germany ..... 337/255

*Primary Examiner*—H. Broome
*Attorney, Agent, or Firm*—Dowell & Dowell

[57] ABSTRACT

Miniature plug-in fuses which include a first active pair of generally parallel blade contact elements which are connected by a first fuse link and a second spare pair of generally parallel blade contact elements which are oriented oppositely of the first pair of blade elements and are electrically insulated therefrom so that when the first fuse link is interrupted due to an overload in an electrical circuit, the plug-in fuse is reversed so that the second pair of blade contact elements and second fuse link provide a spare fuse of the same amperage rating.

6 Claims, 1 Drawing Sheet

Fig. 1
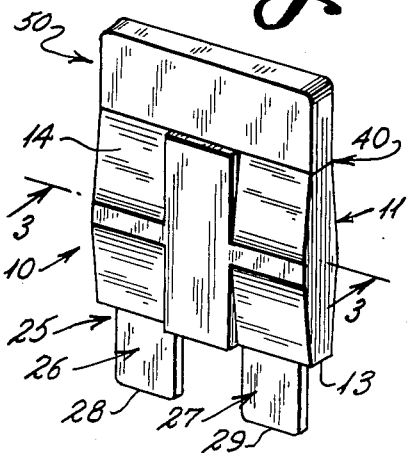
Fig. 2
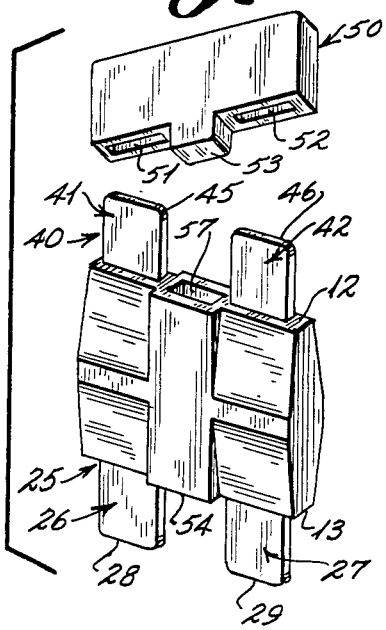
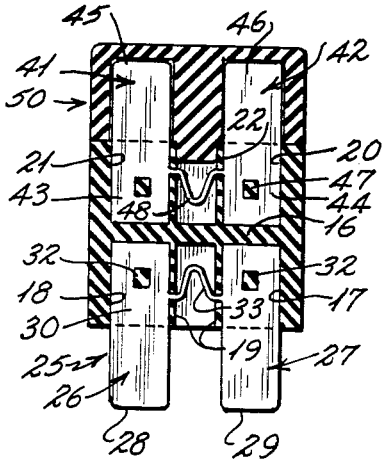
Fig. 3

REVERSIBLE BLADE TERMINAL FUSES

BACKGROUND OF THE INVENTION

1. Field of the Invention

This invention is generally directed to spare fuses of the miniature type which are normally used in electrical circuits requiring low amperage rated fuses generally not exceeding thirty amps. More particularly, the invention is directed to reversible blade terminal fuses having an electrically insulated body portion or housing having upper and lower portions and from which a first fuse assembly extends from the lower portion of the housing and a second fuse assembly extends from the upper portion of the housing. The first and second fuse assemblies are separated by electrical insulating material and operate independently of one another. Each fuse assembly includes a pair of parallel blade contact elements which are adapted to be received within a female socket of a circuit panel board or box. Each of the flat blade elements is interconnected by a fuse link with the fuse links having the same amperage ratings.

In the preferred embodiment of the invention, a separate cap member is provided so as to overlie the pair of flat blade elements which are not in use. If desired, the cap member may be formed of a resilient material so as to permit the cap to be frictionally urged against the blade elements when removing the reversible fuse from a fuse box or panel.

2. History of the Related Art

Miniature fuse elements are utilized in many electrical circuits and are probably more often encountered by individuals who have found it necessary to replace blown fuses in an automobile's electrical circuit. In the automotive industry, miniature fuses are utilized to protect electrical circuits which connect such accessories as the headlights, tail lights, interior lights, panel lights, horn, radio, windshield wipers and like to the automotive electrical source. In the event of an overload or overheating of an electrical circuit, the fuse elements would interrupt the flow of electricity from the power source to the individual electrical accessories thereby insuring that the accessories are not damaged by such overloads.

Unfortunately, when a miniature fuse is blown the electrical components in the circuit to which the fuse is attached can no longer be powered with electrical energy and therefore it is necessary to replace the fuse element before normal operation of a particular component may be accomplished. This is often very inconvenient especially if a fuse is connected to the headlights or tail lights of an automotive vehicle and it is necessary the use of lights to permit safe operation of the vehicle. In these instances, a very inexpensive and minor fuse element may cause severe inconvenience for an individual who must take necessary steps to replace the blown fuse prior to the operation of vehicle.

Often, motorists do not carry spare fuse elements in a vehicle and therefore the vehicle must be abandoned until such time as a fuse of the proper amperage rating is obtained and installed. In other instances, motorists who are aware of the need for spare fuse elements may indeed have spare fuses stored in a glove compartment or trunk but may have fuses of improper amperage ratings. In either case, the inconvenience which is caused by the simple need to replace a blown fuse element can at some times be a major annoyance and both potentially costly and time consuming.

Until recently, most miniature fuses used in the automotive industry were conventional, cylindrical glass fuses. Such fuses have oppositely oriented metal contacts at each end of the glass cylinder and a fuse wire extending between the opposite contacts. A blown fuse could be detected by a visual inspection of the cylindrical housing of the fuse. Such fuses however were extremely difficult to handle when being removed from the mounting clips in a fuse box or panel. In some instances, the glass cylinders or housing would fracture when being removed from a seated engagement with their contact elements thereby making the fuses themselves somewhat unsafe to handle. More recently, automotive manufacturers have begun to utilize what are known as flat terminal blade miniature plug-in fuses. Such fuses are normally constructed having a pair of generally planer and parallel electrical contact elements which are mounted within an electrically insulated housing. The contact blade elements are joined within the housing by a thin strip of electrical conducting material which is designed to fail at a given amperage so as to prevent an overload through the fuse. These types of fuses are more compact in that the housings and contact elements may be formed in a generally flat configuration thereby permitting the contacts to be made in a relatively small space as compared to the cylindrical fuses of the prior art. Further, such fuses incorporate translucent or transparent plastic to form the housings so that an inspection may be made of the fuse link to determine whether or not a given fuse has been interrupted by an overload in a given circuit. Some examples of prior art flat blade terminal fuses are disclosed in U.S. Pat. No. 3,909,767 to Williamson et al and U.S. Pat. No. 4,499,447 to Greenberg.

Miniature fuses are also found in other environments as previously noted above. In some of these environments, there have been efforts made to overcome the problem and annoyance of the failure of a fuse within the system. Many home appliances and other electronic equipment include in-line miniature fuses which are connected in series with the electrical conductor which extends from a source of power to the given electrical unit. In many situations, such fuses are of a unique construction or of an odd size and therefore the replacement of such fuse elements is not readily accomplished.

In U.S. Pat. No. 4,385,282 to Ahroni a fuse plug is disclosed for use on extension cords to supply power to various electrical equipment is disclosed. In this patent, the electrical plugs include replaceable internal fuses which are mounted inside of the plug so that if one fuse fails, a panel or partition may be shifted so as to move a second or spare fuse in-line with the electrical contacts to thereby reestablish electrical current flow through the plug. Unfortunately, the type of fuse elements and the structure disclosed are not compatible for environments wherein flat blade type electrical fuses are utilized such as in the fuse boxes of automotive vehicles.

A similar type of multiple fuse device which incorporates spare contact elements is disclosed in U.S. Pat. No. 4,196,409 to Juba. As with the prior reference to Ahroni, this patent discloses a structure for providing secondary fuses in a plug element used in an electrical conductor such as an extension cord. With this structure, when one fuse element fails, a rotary switch is provided so as to bring a second fuse element into contact with the conductors of the plug element.

A somewhat more complicated multiple fuse device is disclosed in U.S. Pat. No. 4,443,780 to Huai-Chieh. In this patent, a rotary element is provided with a number of radiating arms which are positioned above circuit contacts in a switch. When an indication is given that a fuse is blown, the switch may be rotated so that the contacts of a second pair of arms engage the electrical circuit contacts to continue power through the switch. Again, this type of structure is not conducive to use in an environment where flat blade type terminal fuses are utilized such as in automotive vehicles.

SUMMARY OF THE INVENTION

This invention is directed to reversible blade terminal fuses which may be utilized in place of conventional miniature blade terminal fuses of low amperage rating. The invention includes an electrically insulated housing having a first fuse assembly mounted in one portion thereof and a second or replacement fuse assembly mounted in another portion thereof with each fuse assembly being generally oppositely directed with respect to one another. Each fuse assembly includes a pair of flat blade electrical contact elements which extend outwardly from the insulated housing so as to provide electrical contact with a female socket in a fuse box or panel. Each of the flat blade electrical contacts is connected within the housing by a fuse link which is designed to be destructible when current is above a given amperage. The amperage rating of each of the fuse assemblies should preferably be the same for each reversible fuse.

In a preferred embodiment of the invention, a cap is provided to overlie the flat blade elements of the fuse assembly which is not in use. The cap may be formed of any type of material although it is preferred the material be resilient so as to permit the material or cap to be urged into tight engagement with the blade elements so as to facilitate the removal of the reversible fuse from a fuse box or panel. The dimensions of the reversible fuse of the present invention are preferrably generally the same as conventional blade terminal fuses.

It is the primary object of the present invention to provide a fuse of the flat blade terminal type wherein the fuse incorporates a primary and auxiliary fuse assembly so that when the primary fuse is blown due to a condition in the electrical circuit, the fuse element may be simply reversed and replaced the fuse box whereby the auxiliary fuse element will make an electrical contact between the components of the electrical system without requiring a separate fuse element to be provided.

It is another object of the present invention to facilitate the replacement of blown fuses of the flat blade terminal type by enabling a single fuse structure to incorporate a replacable fuse element which may be installed by simply reversing the position of the fuse within the fuse box.

It is yet another object of the present invention to provide blade type fuses with a spare fuse assembly incorporated in a common housing so that an immediate replacement fuse is always available to ensure the continuity of a given electrical circuit.

It is also an object of the present invention to provide a reversible fuse element for use in electrical circuits and especially in the electrical circuits of automotive vehicles, marine craft, or aircraft in which the circuit interruption caused by a failure of a fuse element may be corrected as expeditiously as possible by providing a reversible fuse within the fuse box or panel.

It is yet another object of the present of invention to facilitate the safe replacement of electrical fuses in fuse boxes and especially fuse boxes utilizing flat blade type miniature fuses. All too often, consumers may substitute a fuse of a higher amperage rating for a fuse which has blown thereby running the risk that an overload may be created in a given circuit causing failure to an electrical appliance connected in line with a given fuse element. By providing a reversible fuse which carries a replacement fuse element of the same amperage rating as the primary fuse, it is possible to ensure that properly rated fuse element is installed to replace the blown fuse element.

BRIEF DESCRIPTION OF THE DRAWINGS

FIG. 1 is a perspective view of the reversible blade terminal fuse of the present.

FIG. 2 is a perspective assembly view of the reversible blade terminal view of the present invention showing the protective cover removed from the auxiliary fuse assembly.

FIG. 3 is a cross-sectional view taken along lines 3—3 of FIG. 1 and showng the fuse links between each of the primary and auxiliary fuse assemblies.

DESCRIPTION OF THE PREFERRED EMBODIMENT

With continued reference to the drawings, the reversible blade terminal fuse 10 of the present invention is shown as including a housing 11. The housing is preferably formed of an electrically insulated plastic material which may include a nylon or polystyrene plastic and includes upper end 12 and a lower end 13, oppositely oriented front and rear walls 14 and oppositely oriented side walls 15. The housing is divided into upper and lower sections by a central wall member 16. The central wall member 16 divides the housing into upper and lower portions. A pair of open cavities 17 and 18 are formed in the lower portion of the housing and are separated from one another by a pair of insulating wall portions 19. The upper half of the housing includes socket or cavity portions 20 and 21 which are spaced with respect to one another by a pair of wall portions 22.

A first primary fuse assembly 25 is mounted within the lower portion of the housing and includes a pair of generally parallel flat blade elements 26 and 27 which are mounted within the cavities 17 and 18 formed in the lower half of the housing. Each of the blade elements includes an outer contact portion 28 and 29 which are selectively engagable with a female electrical socket (not shown) of the type which is conventionally utilized in a fuse box or panel. The blade elements also include upper portions 30 and 31 which are disposed within the cavities 17 and 18. In order to anchor the blade elements 26 and 27 with respect of the housing, each of the blade elements includes an opening 32 through which a portion of the housing is molded during the assembly of the reversible blade terminal fuse. The lower or primary fuse assembly also includes a destructible fuse link 33 which electrically contacts the blade elements 26 and 27 through the walls 19 of the housing.

The blade elements 26 and 27 are formed of electrically conductive material and are preferably integratly formed with the destructible fuse link 33. In actual practice, the materials that make up the blade elements and fuse link are stamped from a sheet of electrically conductive material in a single operation and are thereafter placed in a mold with the housing being poured into the mold to create a unified assembly. The amperage rating for the primary fuse assembly will be determined by the type of material and the size of the link element 33. Generally, miniature fuses of the flat blade type are constructed in amperage ratings up to approximately 25 to 30 amps.

The reversible blade terminal fuse of the present invention also includes a secondary or auxiliary fuse assembly 40 which is mounted in the upper portion of the housing 11. The auxiliary fuse assembly includes a pair of generally parallel flat blade elements 41 and 42 each of which includes an innermost portion 43 and 44 respectively which are mounted within the cavities 21 and 20 of the upper portion of the housing respectively. Each blade element further includes an outermost electrical contact portion 45 and 46 which are designed to be engagable with a female electrical socket (not shown) in the same manner as the blade elements of the primary fuse assembly. Each of the blade elements is further provided with an opening such as shown at 47 through which the plastic material may be molded in order to secure the blade elements in position within the housing A fuse link 48 extends between the walls 22 of the upper portion of the housing and electrically connects the blade elements 41 and 42 of the auxiliary fuse assembly.

As the auxiliary fuse assembly is designed to be installed in place of the primary fuse assembly, the fuse link 48 is designed to be destructible at the same amperage as the fuse link 33 so that both fuse assemblies have the identical amperage rating. This will ensure that a properly designed fuse element will be reinstalled within a given socket in a fuse box or panel when the primary fuse assembly 25 is replaced.

In order to protect the outer ends 44 and 45 of the auxiliary fuse assembly from damage and to assist in removing and inserting the fuse assemblies of the present invention, an upper cap 50 is provided having a pair of spaced cavities 51 and 52 in which the outer portions 45 and 46 of the auxiliary fuse assembly are selectively received when not in use. The cap member also includes a generally central protrusion 53 which is designed to be engagable in upper and lower cavities 54 which are formed in the upper and lower walls 12 and 13 of the housing. In this manner, the cap will be frictionally engaged with the housing and will not be easily dislodged with respect to the contact elements of the fuse assembly to which the cap is secured.

The cap is preferably formed of a rubber-like material or other flexible plastic material so as to enable the walls defining the cavities 51 and 52 to be collapsed or urged against the contact elements 45 and 46 so as to provide a further area for gripping the fuse when the fuse is urged from engagement with an electrical socket. Also, in order to properly identify the amperage rating of the fuse element, the amperage rating may be noted on the cap as well as on the fuse housing.

The cap is designed to be placed over the outer ends 28 and 29 of the blade elements 26 and 27 of the primary fuse assembly when the primary fuse assembly is no longer in use.

In the use of the reversible blade terminal fuses of the present invention, the primary fuse assembly is initially installed within the fuse box or panel so as to provide a safeguard in a given electrical circuit. In an event of an overload in the circuit the fuse link 33 will destruct thereby terminating power through the circuit. The housing may be made of a clear or transparent material so that a visual indication of the failure of the fuse link 33 may be readily determined. As an alternative, openings may be made through the sidewalls of the housing to provide access to probes so that an electrical tester may be applied to each of the blade elements 25 and 27 to determine continuity through the fuse element.

Once the fuse element 33 has been destroyed, the fuse may be replaced by simply urging the cap member into compressed engagement about the blade elements of the auxiliary fuse assembly and urging the entire reversible fuse from engagement with the electrical socket. The housing is thereafter reversed and the auxiliary blade elements inserted into the electrical socket. The reversible blade assembly allows a properly rated fuse element to be instantaneously placed in line with a given electrical circuit thereby reducing down time and ensuring a safe operation of the electrical circuit.

I claim:

1. A reversible blade terminal fuse comprising a said housing having upper and lower ends and spaced side and front and rear wall portions, said housing being formed of an electrical insulating material and having upper and lower portions which are separated by an electrically insulating wall portion, a first fuse assembly mounted within said lower portion of said housing, said first fuse assembly including a first pair of generally parallel blade elements having outer end portions which extend from the lower wall of the housing and inner end portions which are secured within said housing, a first fuse link means electrically connecting said first blade elements, an auxiliary blade assembly mounted within said upper portion of the housing, said auxiliary fuse assembly including a second pair of parallel spaced blade elements, each of said second blade elements having outer end portions extending outwardly from said upper wall portion of said housing and having inner portions secured within said upper portion of said housing, second fuse link means electrically connecting said second blade elements within said housing, each of said first and second pair of blade elements formed of an electrically conductive material whereby when said primary fuse element is interrupted through said first fuse link, said housing may be rotated so that said auxiliary fuse element may be utilized in replacement of said primary fuse assembly.

2. The reversible blade terminal fuses of claim 1 in which said first and second fuse links have the same amperage rating.

3. The reversible blade terminal fuses of claim 2 in which the amperage rating does not exceed approximately 30 amps.

4. The reversible blade terminal fuses of claim 2 including a cap means, said cap means including socket means for selectively receiving said outer ends of one of said first and second pair of blade elements when said blade elements are not in use.

5. The reversible blade terminal fuses of claim 4 in which said cap means is formed of a flexible material so as to be collapsible relative to said blade elements.

6. The reversible blade terminal fuses of claim 5 in which said cap means includes a central protrusion, said housing having a central opening formed in each of said upper and lower wall portions, said openings being of a size to frictionally receive said centrical protrusion of said cap means.

* * * * *